United States Patent [19]

Ueno et al.

[11] Patent Number: 4,619,667

[45] Date of Patent: Oct. 28, 1986

[54] METHOD FOR INCREASING COLOR DENSITY AND IMPROVING COLOR FASTNESS OF DYED FABRICS

[75] Inventors: Susumu Ueno; Hirokazu Nomura, both of Ibaraki; Shinobu Hashizume; Toshiaki Nishide, both of Fukui, all of Japan

[73] Assignees: Shin-Etsu Chemical Co., Ltd, Tokyo; Emori & Co., Ltd; Nikka Chemical Ind. Co., Ltd, all of Japan

[21] Appl. No.: 743,506

[22] Filed: Jun. 11, 1985

Related U.S. Application Data

[63] Continuation-in-part of Ser. No. 557,667, Dec. 2, 1983, abandoned.

[30] Foreign Application Priority Data

Feb. 12, 1982 [JP] Japan ..... 57-211692
Feb. 12, 1982 [JP] Japan ..... 57-211691

[51] Int. Cl.[4] ..... D06P 5/20
[52] U.S. Cl. ..... 8/444; 427/41
[58] Field of Search ..... 8/444; 427/41

[56] References Cited

U.S. PATENT DOCUMENTS 3,617,187 11/1971 Chitani et al. ..... 8/444
4,400,424 8/1983 Hatada ..... 428/212
4,451,534 5/1984 Akagi ..... 428/375
4,533,369 8/1985 Okita ..... 427/41

FOREIGN PATENT DOCUMENTS 0110416 6/1984 European Pat. Off. ..... 8/444
3017776 12/1980 Fed. Rep. of Germany ..... 8/444
150912 9/1981 German Democratic Rep. .... 8/444

*Primary Examiner*—Theodore Morris
*Attorney, Agent, or Firm*—Toren, McGeady, Stanger, Goldberg & Kiel

[57] ABSTRACT

The invention provides a method for increasing the color density of a dyed fabric material of, especially, a synthetic fiber as well as the fastness of the color to rubbing and washing. The inventive method comprising (a) pretreating the dyed fabric material with an organopolysiloxane which is an amino-modified organopolysiloxane or a dimethylpolysiloxane, and then (b) exposing the thus pretreated dyed fabric material to low temperature plasma of an inorganic gas under a reduced pressure. The inorganic gas is preferably oxygen or a gaseous mixture containing at least 10% by volume of oxygen. The color-deepening effect is particularly remarkable when the color of the dyed fabric material is black to impart increased graveness and vividness of the color.

4 Claims, 1 Drawing Figure

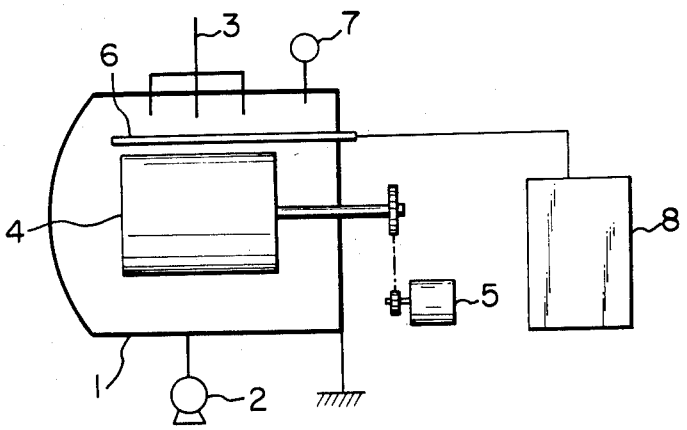
3
7
6
4
8
5
1
2

METHOD FOR INCREASING COLOR DENSITY AND IMPROVING COLOR FASTNESS OF DYED FABRICS

BACKGROUND OF THE INVENTION

This is a continuation-in-part application from a copending U.S. patent application Ser. No. 557,667 filed Dec. 2, 1983 now abandoned.

The present invention relates to a method for increasing the color density of a fabric material composed of, mainly, a synthetic fiber and dyed, in particular, in black color along with the effect of improving the color fastness of the dyed fabric material even when the dyeing of the fabric material is preceded by a treatment with various kinds of fabric finishing agents which may eventually have an adverse effect of decreasing the fastness of the color imparted to the fabric material in the subsequent dyeing process.

In the fabric dyeing industry, it is a usual practice to undertake certain measures for increasing the color density of the dyed fabrics to obtain a deeper color subsequent to dyeing with an object to decrease the concentration of the dye in the dyeing bath. This problem is particularly important in the fabric materials dyed in black in order to give an impression of a grave and vivid black color. In view of the problem of the dyeability of the fibers, the efforts for developing a method of deeper-colored dyeing or increasing the color density of dyed fabric materials hitherto undertaken have been mainly concentrated to those of synthetic fibers including a method in which the surface of the fiber per se is provided with microscopically fine craters by a subtle control of the spinning conditions and a method in which the surface of the fibers is treated with a liquid dispersion of colloidal silica to deposit the silica particles thereon which form microscopic ruggedness on the fiber surface to reduce the reflectivity of light. The former method of microcrater formation on the fiber surface is, however, not versatile to be applicable to any types of synthetic fibers and the latter method of the treatment with a colloidal silica dispersion is defective due to the poor durability of the effect obtained by the treatment which is readily lost by laundering or other treatment after dyeing.

Alternatively, another method has been proposed in the above described object in which dyed fabric materials are treated with certain kinds of synthetic resins such as acrylic resins, fluorocarbon resins, silicone resins and the like to provide a coating layer on the fiber surface which may alter the behavior of light in reflection on the fiber surface to give a viewer's visual impression of a deepened color. This method is, however, also not free from the problem of the poor durability of the effect and, in addition, defective in the decreased color fastness of the dyed fabric materials, possible influences by the types of dyes and other fabric finishing agents used in combination with the above mentioned resins and eventual shifts caused in the hues and color tones of the dyed fabric materials.

Further, it is a very common practice that fabric materials of synthetic fibers are subjected to various types of finishing treatments including soft finish, hard finish, water-and/or oil-repellent finish, shrink-resistant finish, crease-resistant finish, antistatic finish and the like according to the particular requirements for the fabric materials such as improvements in feeling, touch, mechanical properties and functions and other objects.

One of the serious problems in these finishing treatments is the decreased color fastness or, in particular, the color fastness in washing and rubbing when a dyed fabric material is subjected to such a finishing treatment after dyeing. The grade of the color fastness may sometimes decrease by one to three points by such a finishing treatment of a dyed fabric material to cause a great loss in the commercial value of the product. Therefore, the types of the finishing agents and the procedures of the finishing treatment are under very strict restrictions for the reason of this problem in order to minimize the decrease in the color fastness of a dyed fabric material with full exhibition of the desired effects by the finishing treatment. Therefore, it has been a very important problem for the engineers pertaining to the manufacture of fabric-finishing agents or the process of fabric finishing by use thereof to develop an agent or a method with which or in which the problem of the decreased color fastness of a dyed fabric material by a finishing treatment is solved as far as possible although all of the hitherto proposed methods provide only a partial solution of the problem to give a color fastness approximating that of the unfinished dyed fabric material and not to give a fastness inherent to the dye per se.

As viewed from the other side, the above described problem of the decreased color fastness of a dyed fabric material by the finishing treatment is a limiting factor for the selection of dyes since a dye having a serious drawback in this respect is, whatever excellent properties it may have otherwise, e.g. level dyeing, not usable when the dyed fabric material is subsequently subjected to a finishing treatment to cause a large decrease in the color fastness.

Accordingly, it has been eagerly desired to develop an effective and inexpensive method for increasing the color density of a dyed fabric material as well as improving the color fastness of a dyed fabric material even when the dyed fabric material is subsequently subjected to a finishing treatment by use of a variety of finishing agents currently on use in the fabric industry.

SUMMARY OF THE INVENTION

It is therefore an object of the present invention to provide a novel and improved method for increasing the color density of a dyed fabric material by a post-treatment subsequent to dyeing without increasing the concentration of the dye in the dyeing bath and, in the case where the dyed fabric material is subsequently finished by use of one or more of the fabric finishing agents, the color fastness of the dyed fabric material is not decreased by such a finishing treatment.

The method of the present invention developed as a result of the extensive investigations undertaken by the inventors comprises the successive steps of (a) treating a dyed fabric material with an amino-modified organopolysiloxane or a dimethylpolysiloxane having a viscosity in the range from $10^2$ to $10^8$ centistokes at 25° C. and (b) then subjecting the thus treated dyed fabric material to exposure to low temperature plasma of an inorganic gas under a pressure in the range from 0.01 to 10 Torr.

BRIEF DESCRIPTION OF THE DRAWING

The FIGURE is a schematic illustration of an apparatus for the low temperature plasma treatment in the invention.

DETAILED DESCRIPTION OF THE PREFERRED EMBODIMENTS

Although the inventive method is very simple and can be performed inexpensively as is mentioned above, the method of the invention is very effective so that the effect of increasing the color density of a dyed fabric material by the inventive method is larger by 1.5 to 2 times than in the conventional methods consequently contributing to 10 to 30% saving of the dye to obtain a desired color density. Further, in connection with the decrease in the color fastness of a dyed fabric material caused by a finishing treatment after dyeing, not only the decrease in the fastness can be prevented by the treatment of the invention but also the fastness can even be increased by one to four points in comparison with the fastness without the finishing treatment so that the selection of the dyes and the finishing agents as well as the procedures of finishing are freed from the hitherto unavoidable limitations to greatly contribute to the increase in the variety of fabric materials with large commercial values.

In the first place, the method of the present invention is applicable to any types of fibers but the effect of the inventive method is most remarkably exhibited when the dyed fabric material is made of a synthetic fiber such as polyester fibers, nylon fibers, acrylic fibers, polypropylene fibers, cellulose acetate fibers, polyvinyl alcohol fibers and the like and the form of the fabric material is not particularly limitative including woven cloths, knit fabrics and non-woven fabrics as well as threads and yarns. It is of course that these fabric materials are made of two kinds or more of different types of fibers including natural fibers provided that, for example, the weight proportion of the synthetic fibers is about 50% by weight or more. The fabric material should be dyed before being subjected to the method of the present invention and the kind of the dye used for dyeing is not particularly limitative including any commercially available ones used for dyeing although it should be noted that the effect of the inventive method for increasing the color density is most strongly exhibited when the dyed fabric material is dyed in black.

In the first step (a) of the inventive method, the dyed fabric material is treated with an amino-modified organopolysiloxane or a dimethylpolysiloxane. Various commercial products of aqueous emulsion compositions comprising an amino-modified organopolysiloxane as the dispersant are available. The amino-modified organopolysiloxane in such a composition is a diorganopolysiloxane having a substantially linear molecular structure having amino-substituted alkyl groups of the formula —R—$NH_2$ or (2-aminoethyl)amino-substituted alkyl groups of the formula —R—NH—$CH_2CH_2$—$NH_2$ bonded to the silicon atoms in the molecule, in which R is a divalent hydrocarbon group or, in particular, an alkylene group such as ethylene, propylene and the like. The diorgnopolysiloxane should contain preferably from 0.05 to 10% by moles of the above mentioned amino-substituted groups based on the overall organic groups bonded to the silicon atoms and at least 60% by moles of the organic groups other than the above mentioned amino-substituted groups should preferably be methyl groups. The organic groups other than methyl and amino-substituted alkyl groups are exemplified by alkyl groups such as ethyl and propyl groups, halogenated alkyl groups such as chloromethyl, chloropropyl and trifluoropropyl groups, unsaturation-containing groups such as vinyl, allyl, acryloxypropyl and methacryloxypropyl groups, epoxy-substituted groups such as 3-glycidyloxypropyl group, aryl groups such as phenyl group and alkoxy groups such as methoxy, ethoxy and propoxy groups. The above defined amino-substituted diorganopolysiloxane is particularly suitable as the pretreatment agent of the fabric material and capable of giving a finished fabric product imparted with a good balance of the color density or color thickness and the feeling or touch of the material.

Alternatively, the pretreatment agent used in the step (a) of the inventive method may be a dimethylpolysiloxane having a viscosity, preferably, in the range from $10^2$ to $10^8$ or, more preferably, at least $10^3$ centistokes at 25° C. in order to obtain a full effect of color-deepening in the inventive method. Preferably, the pretreatment agnet should be an aqueous emulsion containing such a dimethylpolysiloxane as the dispersant. It is not always necessary that the organic groups bonded to the silicon atoms in the dimethylpolysiloxane are limited to methyl groups provided that the molar content of other organic groups does not exceed 20%. The organic groups other than methyl are exemplified by those groups given as the exemplification of the organic groups other than the amino-substituted alkyl and methyl groups in the amino-substituted diorganopolysiloxane. It is preferable that the molecules of the dimethylpolysiloxane, which have a substantially linear molecular structure, are trminated at both molecular chain ends each with a silanolic hydroxy group bonded to the terminal silicon atom.

The process for the treatment of a fabric material with the above described pretreatment agent is well known in the art of fabric processing including the method of dipping, padding, roll-coating, spraying and the like followed by a post-treatment of soaping, rinsing with hot water, etc. and drying. The amount of the pretretment agent deposited on the fabric material in this pretreatment is usually in the range from $10^{-3}$ to $10^{-2}$ g/g of the fabric material.

It is of course optional that the pretreatment agent, of which the principal ingredient is the above described organopolysiloxane compound, may be admixed with a relatively small amount of other resinous fabric-finishing agents such as urethane resins, melamine resins, fluorocarbon resins, acrylic resins, polyacrylamide resins, polyester resins and the like as well as certain organopolysiloxane resins modified with polyoxyalkylene groups, epoxy groups, fluoroalkyl groups and the like.

The fabric material pretreated in the above described manner with the pretreatment agent containing an organopolysiloxane is then subjected to a treatment with low temperature plasma in the step (b) of the inventive method. The procedure of the low temperature plasma treatment is also well known in the art. That is, the dyed fabric material under treatment is placed inside a plasma chamber capable of being evacuated to a reduced pressure and equipped with two or two sets of discharge electrodes, one or one set thereof being grounded and the other or the other set thereof serving as a power electrode, and low temperature plasma is generated inside the plasma chamber by supplying an electric power to the electrodes at a voltage of, for example, 400 volts or higher while the atmosphere inside the plasma chamber is kept under a reduced pressure with a stream of an inorganic gas.

Suitable inorganic gases to fill the plasma chamber under a reduced pressure are exemplified by helium, neon, argon, nitrogen, oxygen, air, nitrous oxide, nitrogen monoxide, nitric oxide, carbon monoxide, carbon dioxide, bromine cyanide, sulfur dioxide, hydrogen sulfide and the like. These inorganic gases may be used either alone or as a mixture of two kinds or more according to need. In particular, it is preferable in the inventive method that the inorganic gas is an oxidizing gas which may be oxygen or a gaseous mixture containing at least 10% by volume of oxygen.

The pressure of the gaseous atmosphere inside the plasma chamber is preferably in the range from 0.01 to 10 Torr. Low temperature plasma is readily generated with stability by the glow discharge in the atmosphere under a pressure in this range by supplying an electric power of, for example, 10 watts to 100 kilowatts at a frequency of 10 kHz to 100 MHz between the electrodes installed inside the plasma chamber although the frequency is not particularly limited to the above mentioned high frequency range but may be direct current, low frequency or a frequency of microwave range. The electrodes are not necessarily installed inside the plasma chamber but may be installed outside the plasma chamber or may be replaced with a single work coil for high frequency surrounding the plasma chamber although installation of the discharge electrodes inside the plasma chamber is preferable from the standpoint of obtaining effective results of the low temperature plasma treatment. These electrodes are connected to the power source, e.g. high frequency generator, either by capacitive coupling or by inductive coupling.

The forms of the electrodes are also not particularly limitative and the power electrode and the grounded electrode may be of the same form or different forms from each other. Plate-like, ring-like, rod-like and cylindrical electrodes are equally suitable though dependent on the particular requirements. A convenient design of the discharge electrodes is that the walls of the plasma chamber are made of a metal to serve as a grounded electrode and a power electrode of a suitable form is installed inside the plasma chamber as insulated from the walls. Assuming that the electrodes are installed inside the plasma chamber, the distance between the grounded and power electrodes is preferably in the range from 1 to 30 cm or, more preferably, from 2 to 10 cm in order to obtain higher efficiency of the treatment.

The material of the electrodes should of course be conductive and copper, iron, stainless steel, aluminum and the like metals are suitable as the material of the electrodes. In order to ensure stability of the discharge between the electrodes, it is preferable that the surface of the electrodes or, in particular, the power electrode is provided with a heat-resistant and electrically insulating coating layer of, for example, porcelain enamel, glass or ceramic having a dielectric strength or breakdown voltage of, desirably, at least 1000 volts/mm.

In the following, examples are given to illustrate the inventive method and the effectiveness thereof in more detail but not to limit the scope of the invention in any way. As is understood from the examples, fabric materials treated according to the inventive method are imparted with remarkably deepened color with fastness so that the inventive method is economically very advantageous by virtue of the great saving in the amount of the dye required for obtaining a desired color density. The advantage is particularly great in the black dyeing of polyester fibers where the amount of the black dye is remarkably large when a deep black color is desired.

The apparatus for the low temperature plasma treatment used in the following examples is illustrated in the accompanying drawing. In the FIGURE, the plasma chamber 1 is made of a stainless steel and capable of being evacuated by means of the vacuum pump 2 down to a pressure of 0.01 Torr or below. The plasma chamber 1 is provided with a gas inlet 3 through which a gas is introduced into the plasma chamber 1 to constitute the gaseous atmosphere inside the chamber 1. The open end of the gas inlet 3 is branched in manifold (in three branches in the FIGURE) to ensure uniformity of the atmospheric condition inside the chamber 1. A stainless steel-made rotatable cylindrical electrode 4 inside the plasma chamber 1 is supported vacuum-tightly by a faceplate of the plasma chamber 1 in a cantilever manner and driven by an electric motor 5 installed outside the chamber 1 at a controllable velocity. The rotatable cylindrical electrode 4 is electrically grounded through the walls of the plasma chamber 1. The temperature of the rotatable cylindrical electrode 4 can be controlled by passing a heating or cooling medium through inside. Facing the rotatable cylindrical electrode 4, a rod-like electrode 6, which serves as a power electrode, is held in parallel to the rotating axis of the rotatable cylindrical electrode 4 to form a gap of uniform width therebetween. The power electrode 6 is, of course, electrically insulated from the walls of the plasma chamber 1 and connected to the ungrounded terminal of a high frequency generator 8. The pressure inside the plasma chamber 1 can be determined by means of a Pirani gauge 7 connected to the chamber 1.

In performing the low temperature plasma treatment in the above described apparatus, the efficiency of the high frequency generator was controlled at the maximum by changing the position of the tap in the anode coil in order to obtain matching of the impedance of the oscillator tube and the load impedance varying with various parameters such as the kind and pressure of the atmospheric gas, number of the electrodes and others. In the measurement of the high frequency output, the p-p value of the output voltage was obtained by doubling the peak value of the output voltage determined in a circuit comprising a voltage divider, rectifier and D.C. voltmeter. The output current was given by the effective value determined in a circuit comprising a current transformer, current-voltage converter and D.C. voltmeter, of which the current-voltage converter was operating to give an output of a thermocouple in mV detecting the temperature elevation of a heater in proportion to the input current in the heater.

EXAMPLE 1

A georgette crepe cloth of pure polyester fiber dyed in black with 10% (o.w.f.) of Dianix Black BG-FS was treated with either one of the following pretreatment agents I to VII by the padding method of 1 dipping-1 nipping with a 1% aqueous solution of the pretreatment agent to give a pick-up of 103% by weight followed by drying at 105° C. for 3 minutes and then curing at 180° C. for 30 seconds.

I: an aqueous emulsion containing 30% by weight of an amino-modified organopolysiloxane having a viscosity of about 2000 centistokes at 25° C., of which the molar content of the amino-substituted alkyl groups was 1%

II: an aqueous emulsion containing 30% by weight of an amino-modified organopolysiloxane having a viscosity of about 1000 centistokes at 25° C., of which the molar content of the amino-substituted alkyl groups was 0.2%

III: an aqueous emulsion containing 30% by weight of an amino-modified organopolysiloxane having a viscosity of about $10^6$ centistokes at 25° C., of which the molar content of the amino-substituted alkyl groups was 0.3%

IV: an aqueous emulsion containing 30% by weight of a dimethylpolysiloxane having a viscosity of about $10^6$ centistokes at 25° C. and terminated at both molecular chain ends each with a trimethylsilyl group V: an aqueous emulsion containing 30% by weight of a dimethylpolysiloxane having a viscosity of about $10^5$ centistokes at 25° C. and terminated at both molecular chain ends each with a dimethylhydroxysilyl group VI: an aqueous emulsion containing 30% by weight of a dimethylpolysiloxane having a viscosity of about 1000 centistokes at 25° C. and terminated at both molecular chain ends each with a trimethylsilyl group VII: an aqueous emulsion containing 30% by weight of a dimethylpolysiloxane having a viscosity of about 100 centistokes at 25° C. and terminated at both molecular chain ends each with a trimethylsilyl group A test cloth of 30 cm by 30 cm wide taken by cutting each of the thus treated cloths and the same cloth before the treatment with the pretreatment agent was spread and fixed on the rotatable cylindrical grounded electrode of the plasma apparatus as described before and the plasma chamber was evacuated. When the pressure inside the chamber had reached 0.03 Torr, oxygen was continuously introduced into the chamber at a rate of 2 liters/minute so that the pressure inside the plasma chamber was maintained at 0.2 Torr by the balance of the continuous evacuation and introduction of the oxygen gas.

While keeping the atmospheric conditions as described above, low temperature plasma was generated inside the chamber by supplying a high frequency electric power of 15 kilowatts at a frequency of 110 kHz to the electrodes to expose the surface of the cloth to the atmosphere of low temperature plasma for 60 seconds. The p-p value of the discharge voltage was 1700 volts and the effective value of the discharge current was 20 amperes.

The thus plasma-treated test cloths were subjected to the evaluation of the color density and the washing resistance of the color as well as the color fastness by rubbing to give the results shown in Table 1 below. The methods for the evaluation of these items were as follows.

The color density L was calculated from the equation $$L = \sqrt{86.73\ Y},$$

in which Y is the reflectivity at a wavelength of 800 nm determined by use of a color densitometer (Model Macbeth MS 2020 manufactured by Macbeth Co.). Table 1 includes the value of the relative color density or index of each test specimen taking the color density of the untreated cloth as 100.

The washing resistance of the color of the dyed cloths was evaluated by the determination of the value of the color density of the test cloth either before or after washing in an aqueous washing bath. The test of aqueous washing was performed with a 2 g/liter aqueous solution of a synthetic neutral detergent in a bath ratio of 1:30, in which the test cloth was shaken for 10 minutes at 40° C. followed by rinse and dehydration. This cycle of washing, rinse and dehydration was repeated 10 times.

The evaluation of the color fastness to rubbing was performed according to the procedure specified in JIS L 0849 for a test cloth in both dry and wet conditions under a load of 200 g by repeating 100 times of reciprocative rubbing movements.

TABLE 1

| | Pretreatment agent | Color density, L-value (index) Plasma treatment: No | Before washing | After washing | Color fastness to rubbing (dry/wet) Plasma treatment: No | Yes |
|---|---|---|---|---|---|---|
| Example 1 | None | 14.4 (100) | 13.5 (107) | 13.8 (108) | 3 – 4 / 4 | 4 – 5 / 4 – 5 |
| | I | 14.1 (104) | 7.0 (247) | 9.6 (198) | 4 – 5 / 5 | 5 / 5 |
| | II | 12.7 (122) | 9.9 (164) | 11.8 (160) | 4 – 5 / 5 | 5 / 5 |
| | III | 14.0 (106) | 7.9 (206) | 10.9 (184) | 4 – 5 / 5 | 5 / 5 |
| | IV | 14.4 (100) | 6.7 (243) | 8.1 (200) | 4 – 5 / 5 – 4 | 5 / 5 |
| | V | 14.2 (103) | 6.1 (261) | 7.5 (212) | 5 – 4 / 5 | 5 / 5 |
| | VI | 14.3 (103) | 7.2 (236) | 8.4 (190) | 5 – 4 / 5 | 5 / 5 |
| | VII | 14.3 (99) | 8.2 (208) | 9.6 (178) | 4 – 5 / 5 | 5 / 5 |
| Example 2 | None | 16.4 (100) | 15.1 (112) | 15.4 (108) | 3 / 3 | 3 / 3 |
| | I | 15.6 (108) | 11.8 (160) | 12.4 (150) | 4 / 4 | 5 / 5 |
| | II | 14.4 (120) | 13.2 (141) | 14.7 (134) | 4 / 4 | 5 / 5 |
| | III | 15.5 (107) | 12.5 (152) | 13.2 (143) | 4 / 4 | 5 / 5 |
| | IV | 14.9 (116) | 10.8 (180) | 12.2 (158) | 3 / 3 | 3 – 4 / 4 |
| | V | 14.8 (115) | 10.3 (185) | 11.7 (162) | 3 – 4 / 3 | 4 / 4 |
| | VI | 14.8 (115) | 11.7 (172) | 12.5 (152) | 3 – 4 / 3 | 4 / 4 |
| | VII | 14.9 (116) | 11.8 (164) | 12.8 (146) | 3 – 4 / 3 | 4 / 4 |

EXAMPLE 2

A woven cloth of pure polyester gaberdine cloth for black schoolboy uniform was subjected to the pretreatment with either one of the pretreatment agents I to VII described in Example 1 by the method of padding with 1 dipping-1 nipping with a 3% by weight aqueous solution of each agent to give a pick-up of 80% by weight followed by drying at 105° C. for 5 minutes and then curing at 180° C. for 30 seconds.

Each of the thus pretreated cloths as well as a cloth before the pretreatment cut in 30 cm by 30 cm wide was subjected to the low temperature plasma treatment in substantially the same manner as in Example 1. Thus, the plasma chamber was evacuated and, when the pressure inside the plasma chamber had reached 0.05 Torr, air was continuously introduced into the chamber at a rate of 5 liters/minute so that the pressure inside the plasma chamber was maintained at 0.4 Torr by the balance of the continuous evacuation and introduction of the air.

While keeping the atmospheric conditions as described above, low temperature plasma was generated inside the chamber by supplying a high frequency electric power of 20 kilowatts at a frequency of 200 kHz to the electrodes to expose the surface of the cloth to the atmosphere of low temperature plasma for 300 seconds. The p-p value of the discharge voltage was 1800 volts and the effective value of the discharge current was 30 amperes.

The thus plasma-treated and untreated cloth specimens were subjected to the evaluation of the color density either before or after 10 times repeated cycle of washing as well as color fastness to rubbing in the same manner as in Example 1 to give the results shown in Table 1.

What is claimed is:

1. A method for increasing the color density and color fastness of a dyed fabric material composed of at least 50% by weight of a synthetic fiber which comprises the steps of: (a) treating a dyed fabric material with an amino-modified organopolysiloxane or a dimethylpolysiloxane having a viscosity in the range from $10^2$ to $10^8$ centistokes at 25° C.; and (b) then exposing the dyed fabric material to low temperature plasma in an atmosphere of an inorganic gas under a pressure in the range from 0.01 Torr to 10 Torr.

2. The method as claimed in claim 1 wherein the inorganic gas is an oxidizing gas which is oxygen or a gaseous mixture containing at least 10% by volume of oxygen.

3. The method as claimed in claim 1 wherein the amount of deposition of the amino-modified organopolysiloxane or a dimethylpolysiloxane on the dyed fabric material is in the range from $10^{-3}$ to $10^{-2}$ g per g of the dyed fabric material.

4. The method as claimed in claim 1 wherein the amino-modified organopolysiloxane has aminoalkyl groups of the formula —R—$NH_2$ or (2-aminoethyl-)aminoalkyl groups of the formula —R—NH—$CH_2CH_2$—$NH_2$, in which R is an alkylene grous, bonded to the silicon atoms in such a molar amount from 0.05 to 10% of all of the organic groups bonded to the silicon atoms.

* * * * *